US008749539B2

(12) United States Patent
Hung et al.

(10) Patent No.: US 8,749,539 B2
(45) Date of Patent: Jun. 10, 2014

(54) DRIVER CIRCUIT FOR DOT INVERSION OF LIQUID CRYSTALS

(75) Inventors: Der-Ju Hung, Taipei (TW); Chun-Sheng Lin, Taipei (TW); Cheng-Chung Yeh, Taipei (TW)

(73) Assignee: Sitronix Technology Corp., Taipei (TW)

( * ) Notice: Subject to any disclaimer, the term of this patent is extended or adjusted under 35 U.S.C. 154(b) by 240 days.

(21) Appl. No.: 12/792,179

(22) Filed: Jun. 2, 2010

(65) Prior Publication Data

US 2011/0037743 A1 Feb. 17, 2011

(30) Foreign Application Priority Data

Jun. 2, 2009 (TW) ..... 98118189 A

(51) Int. Cl.
*G06G 5/00* (2006.01)

(52) U.S. Cl.
USPC ..... 345/209; 345/211

(58) Field of Classification Search
USPC ..... 345/96, 209
See application file for complete search history.

(56) References Cited

U.S. PATENT DOCUMENTS

| | | | | |
|---|---|---|---|---|
| 6,064,363 | A | 5/2000 | Kwon | 345/98 |
| 6,160,535 | A | 12/2000 | Park | 345/153 |
| 6,297,793 | B1 | 10/2001 | Kawahata | 345/98 |
| 6,320,566 | B1 | 11/2001 | Go | 345/99 |
| 6,335,719 | B1 | 1/2002 | An et al. | 345/98 |
| 6,380,919 | B1 | 4/2002 | Koyama et al. | 345/92 |
| 6,424,328 | B1 | 7/2002 | Ino et al. | 345/87 |
| 6,504,523 | B1 | 1/2003 | Sugawara et al. | 345/98 |
| 6,512,505 | B1 | 1/2003 | Uchino et al. | 345/96 |
| 6,549,187 | B1 | 4/2003 | Matsubara et al. | 345/96 |
| 6,559,822 | B2 | 5/2003 | Okuzono | 345/96 |
| 6,566,643 | B2 | 5/2003 | Morita | 250/208.1 |
| 6,590,555 | B2 | 7/2003 | Su et al. | 345/92 |
| 6,593,905 | B1 | 7/2003 | Lay | 345/92 |
| 6,724,362 | B2 | 4/2004 | Min | 345/100 |
| 6,784,866 | B2 | 8/2004 | Udo et al. | 345/100 |
| 6,842,161 | B2 | 1/2005 | Song et al. | 345/87 |
| 6,891,522 | B2 | 5/2005 | Song et al. | 345/87 |
| 6,914,644 | B2 | 7/2005 | Fukami et al. | 349/42 |
| 6,980,186 | B2 | 12/2005 | Nakano et al. | 345/88 |

(Continued)

FOREIGN PATENT DOCUMENTS

| | | | |
|---|---|---|---|
| JP | 2007156382 | A | 6/2007 |
| KR | 20020046601 | A | 6/2002 |

(Continued)

*Primary Examiner* — Alexander Eisen
*Assistant Examiner* — Robin Mishler
(74) *Attorney, Agent, or Firm* — Rosenberg, Klein & Lee

(57) ABSTRACT

A driver circuit for dot inversion of liquid crystals includes a positive source supplying a first positive signal and a second positive signal; a negative source supplying a first negative signal and a second negative signal; a first selector unit connected with the sources to receive the first positive signal and the first negative signal; a second selector unit connected with the sources to receive the second positive signal and the second negative signal; a first source connected with the selection unit to alternatively output a first positive voltage and a first negative voltage; a second source connected with the selection unit to alternatively output a second positive voltage and a second negative voltage. When the first source outputs the first positive voltage, the second source outputs the second negative voltage. When the first source outputs the first negative voltage, the second source outputs the second positive voltage.

8 Claims, 4 Drawing Sheets

(56) References Cited

U.S. PATENT DOCUMENTS

| | | | | |
|---|---|---|---|---|
| 7,079,097 | B2 | 7/2006 | Lee | 345/87 |
| 7,079,100 | B2 | 7/2006 | Miyajima et al. | 345/90 |
| 7,187,353 | B2 | 3/2007 | Credelle et al. | 345/88 |
| 7,218,301 | B2 | 5/2007 | Credelle | 345/96 |
| 7,224,415 | B2 | 5/2007 | Yi et al. | 349/54 |
| 7,286,107 | B2 | 10/2007 | Lee et al. | 345/92 |
| 7,420,533 | B2 | 9/2008 | Yun | 345/96 |
| 7,450,102 | B2 | 11/2008 | Lin et al. | 345/98 |
| 7,463,232 | B2 | 12/2008 | Lee et al. | 345/90 |
| 7,522,147 | B2 | 4/2009 | Lin et al. | 345/100 |
| 7,629,953 | B2 | 12/2009 | Fukui | 345/89 |
| 7,633,479 | B2 | 12/2009 | Kobayashi et al. | 345/96 |
| 7,705,950 | B2 | 4/2010 | Lin | 349/144 |
| 7,746,335 | B2 | 6/2010 | Hsu | 345/209 |
| 2001/0046002 | A1 | 11/2001 | Lin et al. | 349/43 |
| 2002/0024482 | A1 | 2/2002 | Song et al. | 345/87 |
| 2002/0050972 | A1 | 5/2002 | Udo et al. | 345/96 |
| 2002/0075212 | A1 | 6/2002 | Song | 345/87 |
| 2002/0084960 | A1 | 7/2002 | Song et al. | 345/87 |
| 2004/0075632 | A1 | 4/2004 | Chou et al. | 345/96 |
| 2004/0189575 | A1 | 9/2004 | Choi et al. | 345/96 |
| 2004/0246213 | A1 | 12/2004 | Credelle et al. | 345/87 |
| 2006/0139282 | A1* | 6/2006 | Gotou | 345/96 |
| 2006/0187164 | A1 | 8/2006 | Okuno | 345/92 |
| 2007/0139327 | A1 | 6/2007 | Liu et al. | 345/89 |
| 2008/0048963 | A1 | 2/2008 | Hsu | 345/96 |
| 2008/0297458 | A1 | 12/2008 | Huang | 345/96 |
| 2009/0295777 | A1* | 12/2009 | Wang | 345/212 |

FOREIGN PATENT DOCUMENTS

| | | | |
|---|---|---|---|
| KR | 20020052071 | A | 7/2002 |
| KR | 20020058796 | A | 7/2002 |
| KR | 20030029698 | A | 4/2003 |
| KR | 20030055892 | A | 7/2003 |
| KR | 20030055921 | A | 7/2003 |
| KR | 20040019708 | A | 3/2004 |
| KR | 20040048523 | A | 6/2004 |
| KR | 20040057248 | A | 7/2004 |
| KR | 20050015030 | A | 2/2005 |
| KR | 20050015031 | A | 2/2005 |
| KR | 20070051800 | A | 5/2007 |
| TW | 350063 | | 1/1999 |
| TW | 374861 | | 11/1999 |
| TW | 543018 | | 7/2003 |
| TW | 543018 | B | 7/2003 |
| TW | 200303003 | | 8/2003 |
| TW | 559753 | | 11/2003 |
| TW | 559753 | B | 11/2003 |
| TW | 573291 | | 1/2004 |
| TW | 573291 | B | 1/2004 |
| TW | 200514010 | | 4/2005 |
| TW | 200521931 | | 7/2005 |
| TW | 200527361 | | 8/2005 |
| TW | 200527362 | | 8/2005 |
| TW | 200529151 | | 9/2005 |
| TW | 200530999 | | 9/2005 |
| TW | 200533990 | | 10/2005 |
| TW | 200703221 | | 1/2007 |
| TW | 200703222 | | 1/2007 |
| TW | 200723232 | | 6/2007 |
| TW | 284878 | B | 8/2007 |
| TW | 200736776 | | 10/2007 |
| TW | I292901 | | 1/2008 |
| TW | I293449 | | 2/2008 |
| TW | 200811796 | | 3/2008 |
| TW | 200816126 | | 4/2008 |
| TW | 200828214 | | 7/2008 |
| TW | 200839364 | | 10/2008 |
| TW | 200847116 | | 12/2008 |
| TW | 200848844 | | 12/2008 |
| TW | 200903428 | | 1/2009 |

* cited by examiner

DRIVER CIRCUIT FOR DOT INVERSION OF LIQUID CRYSTALS

BACKGROUND OF THE INVENTION

1. Field of the Invention

The present invention relates to a driver circuit for dot inversion of liquid crystals. More particularly, the present invention relates to a simplified driver circuit for dot inversion of liquid crystals.

2. Description of the Related Art

In general, a conventional flat panel display is operated to generate pixels by controlling a series of corresponding thin film transistors (TFTs) such that a LCD display can be controlled to display predetermined images. The conventional flat panel display has a plurality of gate driving lines connected with corresponding gates of the thin film transistors so as to control on/off operation of the thin film transistor.

FIG. 1 illustrates polarity diagrams of gates of liquid-crystal capacitors (i.e. CLC) in relation to corresponding sources in two frames when the liquid-crystal capacitors are charged in dot inversion of voltage polarity switching. Referring to FIG. 1, the two frames are a first frame (identified as Frame N) and a second frame (identified as Frame N+1). By way of example, each of Frame N and Frame N+1 has a series of gates (identified as Frame G1, G2, G3, G4, G5) and a series of signal sources (identified as S1, S2, S3, S4, S5). In FIG. 1, positive and negative of polarities are identified as "+" and "−".

FIG. 2 shows conventional voltage waveforms of voltage dot inversion switching of two sources in operating dot inversion of liquid crystals. Referring to FIG. 2, the two sources (first source S1 and second source S2) are switched for dot inversion with respect to a ground line (i.e. common voltage "VCOM"), indicated by a dotted line, between a positive voltage "VP" and a negative voltage "VN" so that the corresponding liquid crystals can be dot-inverted.

In FIG. 2, a solid line represents the voltage waveform of the first source S1 while a dashed line represents the voltage waveform of the second source S2. A symbol "S1+" represents a section of the voltage waveform of the first source S1 when the voltage is positive, and a symbol "S1−" represents a section of the voltage waveform of the first source S1 when the voltage is changed to a negative and vice versa. Correspondingly, a symbol "S2−" represents a section of the voltage waveform of the second source S2 when the voltage is negative, and a symbol "S2+" represents a section of the voltage waveform of the second source S2 when the voltage is changed to a positive and vice versa.

In first dot inversion, as best shown in the left portion of FIG. 2, the voltage of the first source S1 drops from the positive voltage VP to the negative voltage VN, and the voltage of the second source S2 rises from the negative voltage VN to the positive voltage VP synchronously. Alternatively, in second dot inversion, as best shown in the middle portion of FIG. 2, the voltage of the first source S1 rises from the negative voltage VN to the positive voltage VP, and the voltage of the second source S2 drops from the positive voltage VP to the negative voltage VN synchronously. It is apparent from FIG. 2 that the voltages of the first source S1 and the second source S2 are repeatedly switched in the same manner for dot inversion of liquid crystals.

However, conventional driver circuits for dot inversion of liquid crystals are constructed from a great number of additional components or high voltage components. However, there is a need of improving a conventional driver circuit for dot inversion of liquid crystals for simplifying the entire structure, reducing dimensions and power consumption of the driver circuit.

The driver circuit for dot inversion of liquid crystals has been described in many Taiwanese patent application publications and issued patents, for example, including TWN patent appln. Pub. No. 200903428, TWN patent appln. Pub. No. 200848844, TWN patent appln. Pub. No. 200847116, TWN patent appln. Pub. No. 200839364, TWN patent appln. Pub. No. 200828214, TWN patent appln. Pub. No. 200816126, TWN patent appln. Pub. No. 200811796, TWN patent appln. Pub. No. 200736776, TWN patent appln. Pub. No. 200723232, TWN patent appln. Pub. No. 200703221, TWN patent appln. Pub. No. 200703222, TWN patent appln. Pub. No. 200639779, TWN patent appln. Pub. No. 200533990, TWN patent appln. Pub. No. 200527362, TWN patent appln. Pub. No. 200530999, TWN patent appln. Pub. No. 200529151, TWN patent appln. Pub. No. 200521931, TWN patent appln. Pub. No. 200527361, TWN patent appln. Pub. No. 200514010, and TWN patent appln. Pub. No. 200303003; and TWN patent issued Pub. No. I293449, TWN patent issued Pub. No. I292901, TWN patent issued Pub. No. I291157, TWN patent issued Pub. No. I291160, TWN patent issued Pub. No. I284880, TWN patent issued Pub. No. I269257, TWN patent issued Pub. No. I284878, TWN patent issued Pub. No. I269259, TWN patent issued Pub. No I253617, TWN patent issued Pub. No. I240108, TWN patent issued Pub. No. I224697, TWN patent issued Pub. No. 583630, TWN patent issued Pub. No. 581909, TWN patent issued Pub. No. 573291, TWN patent issued Pub. No. 571283, TWN patent issued Pub. No. 559753, TWN patent issued Pub. No. 543018, TWN patent issued Pub. No. 521241, TWN patent issued Pub. No. 525127, TWN patent issued Pub. No. 494383, TWN patent issued Pub. No. 486687, TWN patent issued Pub. No. 374861 and TWN patent issued Pub. No. 350063. Each of the above-mentioned Taiwanese patent application publications and issued patents is incorporated herein by reference for purposes including, but not limited to, indicating the background of the present invention and illustrating the state of the art.

Further, the driver circuit for dot inversion of liquid crystals has also been described in many U.S. patent application publications and issued patents, for example, including US20080297458, US20070139327, US20060187164, US20040189575, US20020084960, US20020075212, US20020050972 and US20020024482; and, U.S. Pat. No. 7,463,232, U.S. Pat. No. 7,450,102, U.S. Pat. No. 7,420,533, U.S. Pat. No. 7,079,100, U.S. Pat. No. 7,079,097, U.S. Pat. No. 6,980,186, U.S. Pat. No. 6,914,644, U.S. Pat. No. 6,891,522, U.S. Pat. No. 6,842,161, U.S. Pat. No. 6,784,866, U.S. Pat. No. 6,724,362, U.S. Pat. No. 6,593,905, U.S. Pat. No. 6,590,555, U.S. Pat. No. 6,566,643, U.S. Pat. No. 6,559,822, U.S. Pat. No. 6,549,187, U.S. Pat. No. 6,512,505, U.S. Pat. No. 6,424,328, U.S. Pat. No. 6,380,919, U.S. Pat. No. 6,320,566, U.S. Pat. No. 6,297,793, and U.S. Pat. No. 6,064,363. Each of the above-mentioned U.S. patent application publications and issued patents is incorporated herein by reference for purposes including, but not limited to, indicating the background of the present invention and illustrating the state of the art.

Yet further, the driver circuit for dot inversion of liquid crystals has also been described in many foreign patent application publications and issued patents, for example, including JP2007156382; KR20070051800, KR20040057248, KR20040048523, KR20040019708, KR20050015031, KR20050015030, KR20000007618, KR100242443, KR20030055921, KR20030055892, KR20030029698, KR20020058796, KR20020058141, KR20020052071, KR20020050040, KR20020046601 and KR20020017340. Each of the above-mentioned Intl. patent application publications and issued patents is incorporated herein by reference for purposes including, but not limited to, indicating the background of the present invention and illustrating the state of the art.

As is described in greater detail below, the present invention provides a driver circuit for dot inversion of liquid crystals. The driver circuit includes a single positive source and a single negative source to form two source-level outputs for positive and negative outputs. The driver circuit further includes selector circuits consisted of low voltage components in such a way as to mitigate and overcome the above problem.

SUMMARY OF THE INVENTION

The primary objective of this invention is to provide a driver circuit for dot inversion of liquid crystals. The driver circuit includes a single positive source and a single negative source to form two source-level outputs for positive and negative outputs so that the number of operational amplifiers applied in the driver circuit can be reduced. Accordingly, the driver circuit is successful in simplifying the entire circuit, reducing dimensions and power consumption.

The secondary objective of this invention is to provide a driver circuit for dot inversion of liquid crystals. The driver circuit further includes selector circuits consisted of low voltage components so as to reduce dimensions and power consumption. Accordingly, the driver circuit is successful in reducing dimensions and power consumption.

The driver circuit for dot inversion of liquid crystals in accordance with an aspect of the present invention includes:

a positive source supplying a first positive signal and a second positive signal;

a negative source supplying a first negative signal and a second negative signal;

a first selector unit connected with the positive source and the negative source to receive the first positive signal and the first negative signal, the first selector unit consisted of low voltage components;

a second selector unit connected with the positive source and the negative source to receive the second positive signal and the second negative signal, the second selector unit consisted of low voltage components;

a first source connected with the first selector unit to alternatively output a first positive voltage and a first negative voltage; and a second source connected with the second selector unit to alternatively output a second positive voltage and a second negative voltage;

wherein when the first source outputs the first positive voltage, the second source outputs the second negative voltage; and wherein when the first source outputs the first negative voltage, the second source outputs the second positive voltage.

In a separate aspect of the present invention, the positive source includes a single operational amplifier.

In a further separate aspect of the present invention, the positive source connects with a selector circuit consisted of low voltage components.

In yet a further separate aspect of the present invention, the negative source includes a single operational amplifier.

In yet a further separate aspect of the present invention, the negative source connects with a selector circuit consisted of low voltage components.

Further scope of the applicability of the present invention will become apparent from the detailed description given hereinafter. However, it should be understood that the detailed description and specific examples, while indicating preferred embodiments of the invention, are given by way of illustration only, since various modifications will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

It is noted that a driver circuit for dot inversion of liquid crystals in accordance with the preferred embodiment of the present invention is suitable for various signal driver circuit systems of liquid crystal displays (LCDs) which are not limitative of the present invention.

Figure 3:
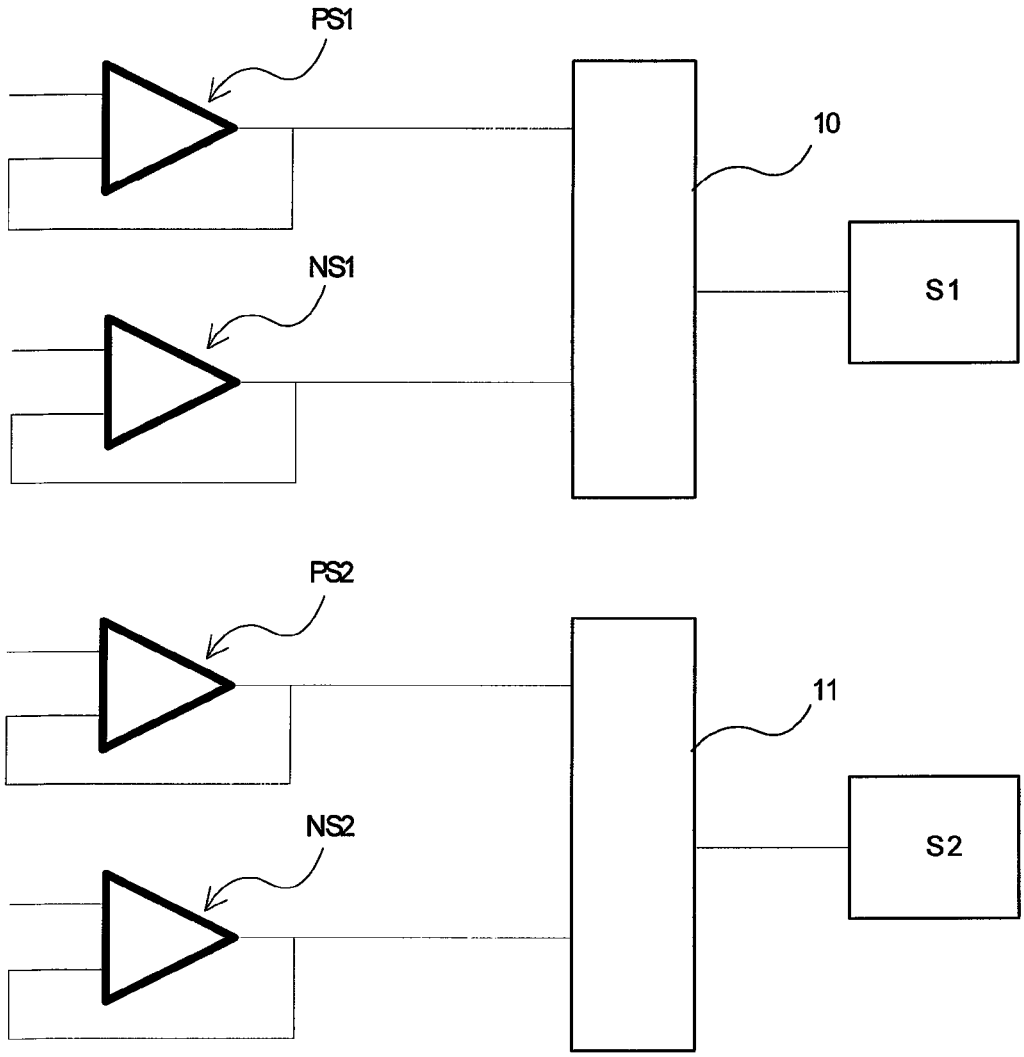
FIG. 3 is a schematic diagram of an example of a driver circuit for dot inversion of liquid crystals.
Figure 4:
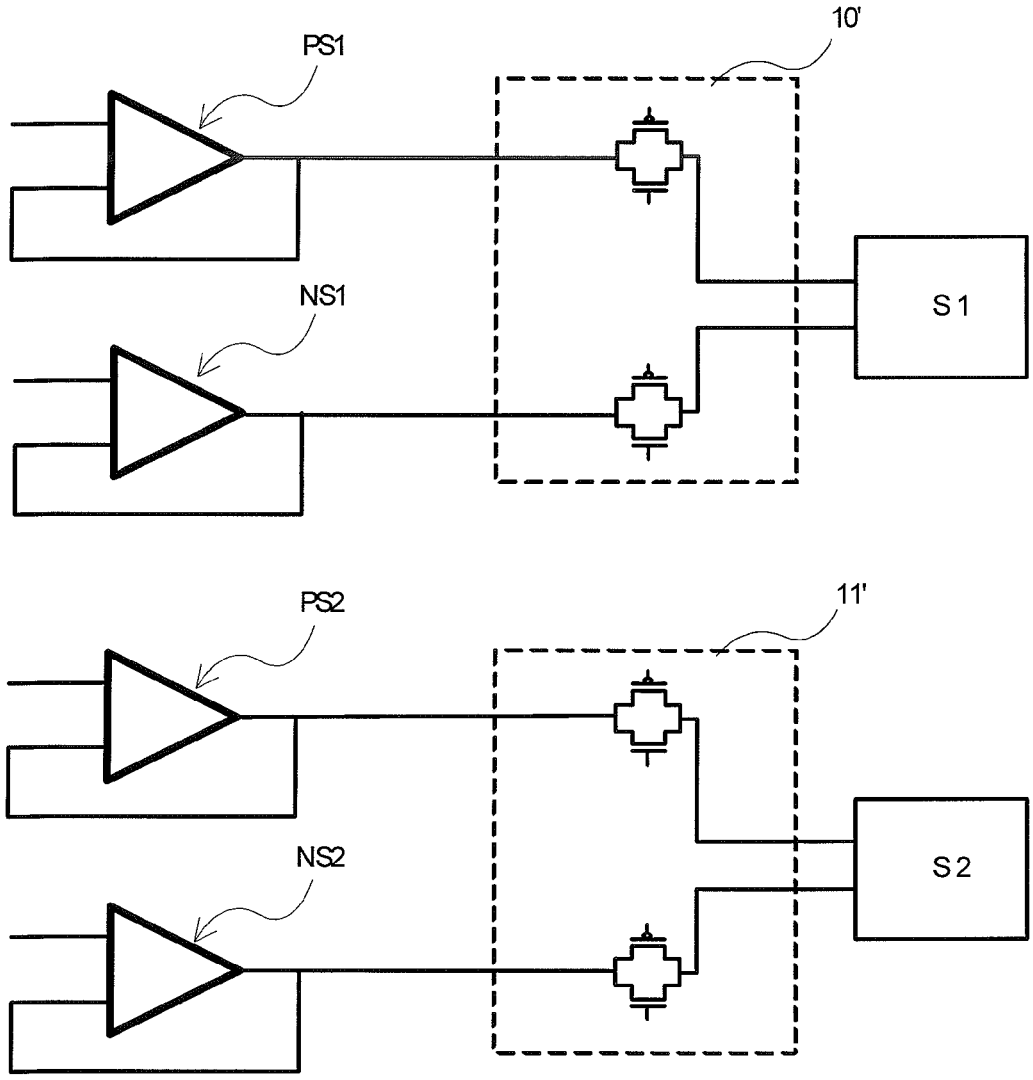
FIG. 4 is a schematic diagram of another example of a driver circuit for dot inversion of liquid crystals.

FIG. 3 illustrates a schematic diagram of an example of a driver circuit for dot inversion of liquid crystals, and FIG. 4 illustrates a schematic diagram of another example of a driver circuit for dot inversion of liquid crystals. Referring to FIGS. 3 and 4, the driver circuit has two source-level outputs connected with a first source S1 and a second source S2, respectively. The first source S1 connects with a first positive source PS1, a first negative source NS1 and a first selector 10, 10' so as to generate positive and negative voltages from the first source S1. Correspondingly, the second source S2 connects with a second positive source PS2, a second negative source NS2 and a second selector 11, 11' so as to generate positive and negative voltages from the second source S2.

As best shown in FIG. 3, the driver circuit requires at least four components of operational amplifiers due to the fact that four sources of the first positive source PS1, the first negative source NS1, the second positive source PS2 and the second negative source NS2 are provided in the driver circuit. However, the number of the operational amplifiers may increase dimensions and power consumption of the driver circuit.

Referring again to FIGS. 3 and 4, with respect to the driver circuit in FIG. 3, the driver circuit shown in FIG. 4 may include two high-voltage components of the first selector 10' and the second selector 11' which can reduce the risk of cross voltage problem. However, the high-voltage first selector 10' and the high-voltage second selector 11' have the defect of increasing dimensions and power consumption of the driver circuit.

Figure 5:
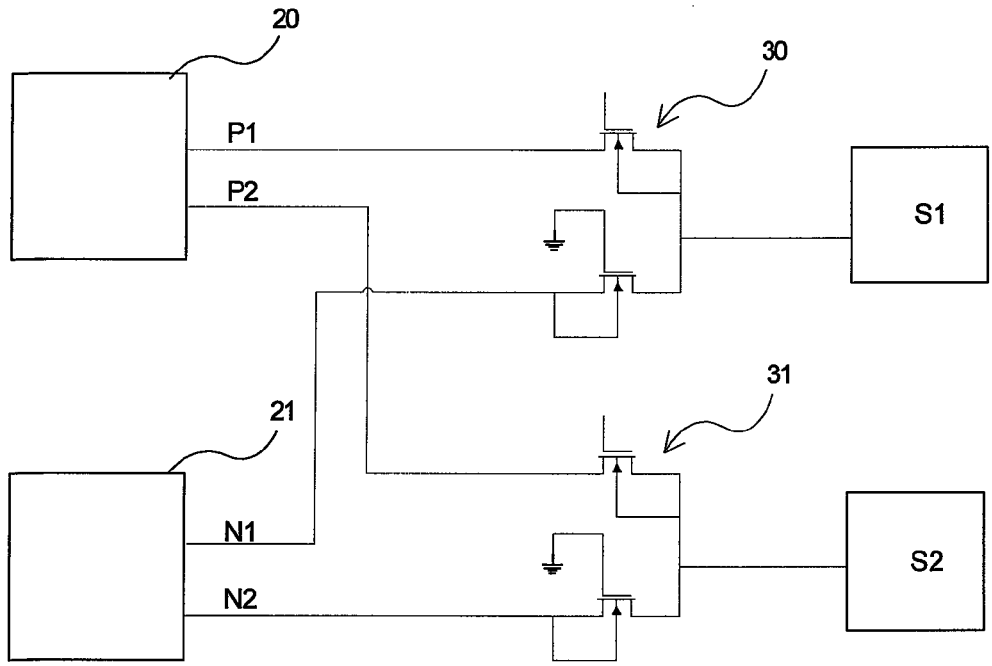
FIG. 5 is a schematic diagram of a driver circuit for dot inversion of liquid crystals in accordance with a first preferred embodiment of the present invention.

Turning now to FIG. 5, a schematic diagram of a driver circuit for dot inversion of liquid crystals in accordance with a first preferred embodiment of the present invention is shown. The driver circuit includes a positive source 20, a negative source 21, a first selector unit 30, a second selector unit 31, a first source S1 and a second source S2 which are electronically connected.

Still referring to FIG. 5, the positive source 20 is used to supply two signals, including a first positive signal (identified as "P1") and a second positive signal (identified as "P2"). Correspondingly, the negative source 21 is used to supply two signals, including a first negative signal (identified as "N1") and a second negative signal (identified as "N2").

With continued reference to FIG. 5, the first selector unit 30 connects with the positive source 20 and the negative source 21 to receive the first positive signal P1 and the first negative signal N1, and the first selector unit 30 is consisted of low voltage components so as to reduce power consumption and dimensions of the first selector unit 30. Correspondingly, the second selector unit 31 connects with the positive source 20 and the negative source 21 to receive the second positive signal P2 and the second negative signal N2, and the second selector unit 31 is consisted of low voltage components so as to reduce power consumption and dimensions of the second selector unit 31.

Figure 1:
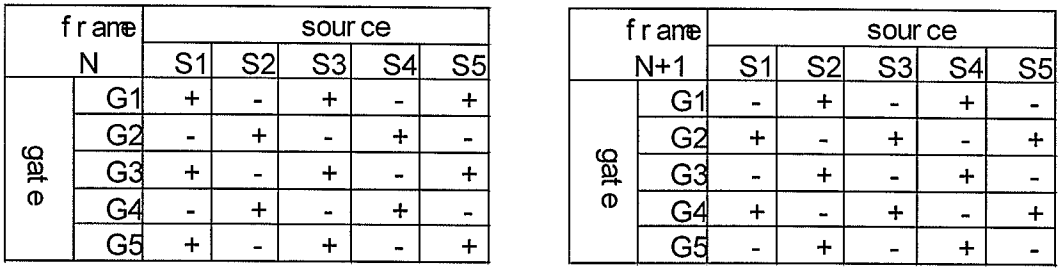
PRIOR ART FIG. 1
FIG. 1 is a chart of polarity diagrams of gates of liquid-crystal capacitors in relation to corresponding sources in two frames when the liquid-crystal capacitors are charged in dot inversion of voltage polarity switching in accordance with the prior art.
Figure 2:
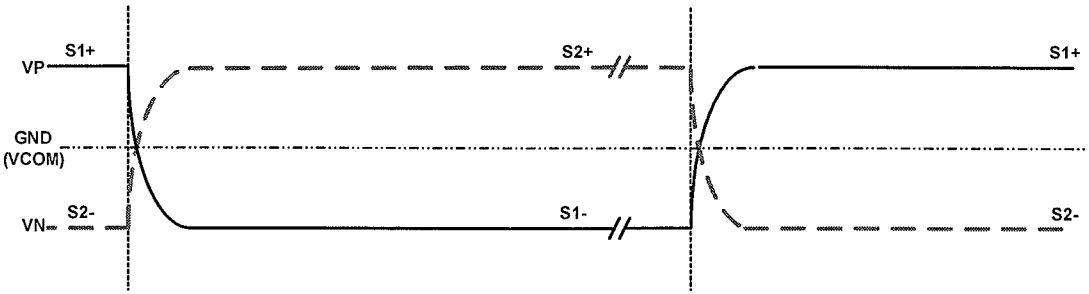
PRIOR ART FIG. 2
FIG. 2 is a series of conventional voltage waveforms of voltage dot inversion switching of two sources in operating dot inversion of liquid crystals in accordance with the prior art.

Still referring to FIG. 5, the driver circuit has two sources of signal outputs, including the first source S1 and the second source S2. The first source S1 connects with the first selector unit 30 to alternatively output a first positive voltage (signal) and a first negative voltage (signal) according to outputs of the first selector unit 30, as best shown in FIG. 1. Correspondingly, the second source S2 connects with the second selector unit 31 to alternatively output a second positive voltage (signal) and a second negative voltage (signal) according to outputs of the second selector unit 31, as best shown in FIG. 1.

Still referring to FIG. 5, the signals of the positive source 20 and the negative source 21 are send to the first source S1 and the second source S2 via the first selector unit 30 and the second selector unit 31 such that the driver circuit can output drive signals for dot inversion from the first source S1 and the second source S2.

Still referring to FIG. 5, the first selector unit 30 has a control unit which is operated to control the first selector unit 30 such that the first source S1 can be controlled to output a positive signal or a negative signal. Correspondingly, the second selector unit 31 has a control unit which is operated to control the second selector unit 31 such that the second source S2 can be controlled to output a positive signal or a negative signal.

Still referring to FIG. 5, in operation, when the first source S1 outputs the first positive voltage P1, the second source S2 outputs the second negative voltage N2. Alternatively, when the first source S1 outputs the first negative voltage N1, the second source S2 outputs the second positive voltage P2.

Figure 6:
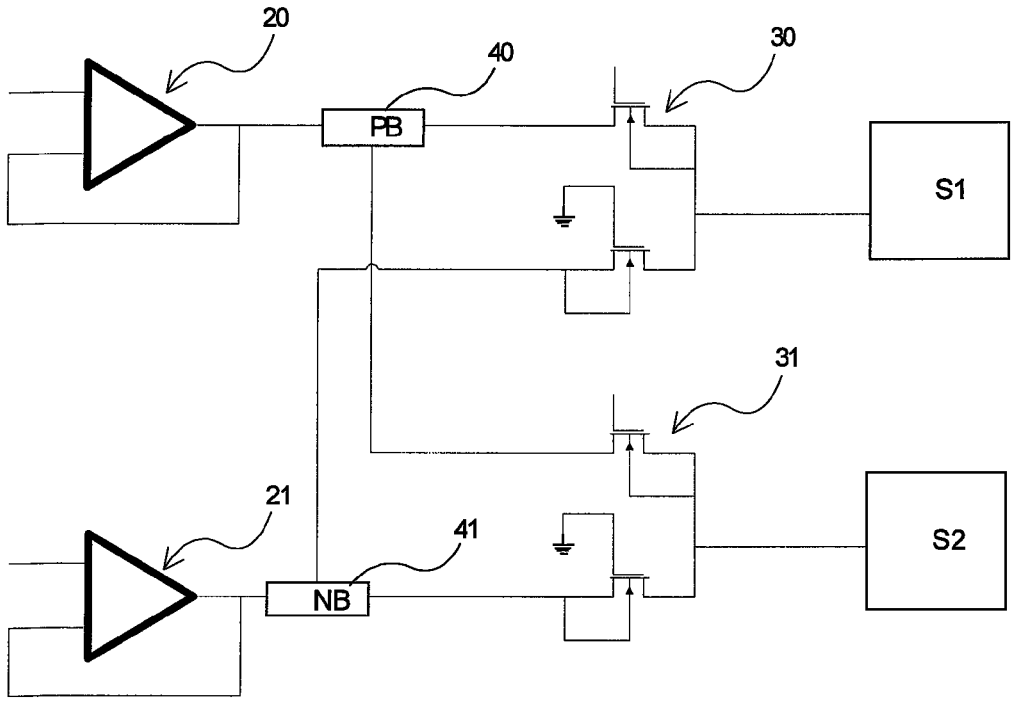
FIG. 6 is a schematic diagram of a driver circuit for dot inversion of liquid crystals, similar to that in FIG. 5, in accordance with a second preferred embodiment of the present invention.

Turning now to FIG. 6, a schematic diagram of a driver circuit for dot inversion of liquid crystals in accordance with a second preferred embodiment of the present invention is shown. Reference numerals of the second embodiment of the present invention have applied the identical numerals of the first embodiment, as shown in FIG. 5. The construction of the driver circuit in accordance with the second embodiment of the present invention has similar configuration and same function as that of the first embodiment and detailed descriptions thereof may be omitted.

Referring to FIG. 6, the driver circuit of the second embodiment of the present invention further includes a first selector circuit 40 and a second selector circuit 41. The selector circuit 40 is consisted of low voltage components and connects with the positive source 20. Correspondingly, the second selector circuit 41 is also consisted of low voltage components and connects with the negative source 21.

With continued reference to FIG. 6, each of the positive source 20 and the negative source 21 has a single operational amplifier such that only two components of the operational amplifiers are provided in the driver circuit of the second embodiment of the present invention.

Referring back to FIGS. 3, 4 and 6, four components of operational amplifiers are provided in the driver circuit, as best shown in FIGS. 3 and 4. Conversely, only two components of the operational amplifiers, as best shown in the left portion in FIG. 6, are provided in the driver circuit of the second embodiment of the present invention which is successful in reducing the number of components.

Although the invention has been described in detail with reference to its presently preferred embodiment(s), it will be understood by one of ordinary skill in the art that various modifications can be made without departing from the spirit and the scope of the invention, as set forth in the appended claims.

What is claimed is:

1. A driver circuit for dot inversion of liquid crystals, comprising:

a positive source supplying a first positive signal and a second positive signal;

a negative source supplying a first negative signal and a second negative signal;

a first selector unit connected with the positive source and the negative source to receive the first positive signal and the first negative signal, wherein the first selector unit consists of a first transistor and a second transistor, the first transistor is coupled to the positive source for receiving the first positive signal, the second transistor is coupled to the negative source for receiving the first negative signal, a gate of the second transistor is coupled to a ground;

a second selector unit connected with the positive source and the negative source to receive the second positive signal and the second negative signal, wherein the second selector unit consists of a third transistor and a fourth transistor, the third transistor is coupled to the positive source for receiving the second positive signal, the fourth transistor is coupled to the negative source for receiving the second negative signal, a gate of the fourth transistor is coupled to the ground;

a first source connected with the first selector unit to alternatively output a first positive voltage and a first negative voltage; and a second source connected with the second selector unit to alternatively output a second positive voltage and a second negative voltage;

wherein when the first source outputs the first positive voltage, the second source outputs the second negative voltage; and wherein when the first source outputs the first negative voltage, the second source outputs the second positive voltage;

wherein, the positive source connects with a first selector circuit, the first selector circuit stop providing the second positive signal to the second selector unit when the first selector circuit provides the first positive signal to the first selector unit, or the first selector circuit stop providing the first positive signal to the first selector unit when the first selector circuit provides the second positive signal to the second selector unit, the negative source connects with a second selector circuit, the second selector circuit stop providing the second negative signal to the second selector unit when the second selector circuit provides the first negative signal to the first selector unit, or the second selector circuit stop providing the first negative signal to the first selector unit when the second selector circuit provides the second negative signal to the second selector unit;

wherein, A first connecting path between the first selector circuit and the first selector unit does only connect with the first selector circuit and the first selector unit, there is no node on the first connecting path, and a second connecting path between the second selector circuit and the second selector unit does only connect with the second selector circuit and the second selector unit without connecting of another switch, there is no node on the second connecting path.

2. The driver circuit as defined in claim 1, wherein the positive source includes a single operational amplifier.

3. The driver circuit as defined in claim 1, wherein the first selector circuit is consisted of low voltage components.

4. The driver circuit as defined in claim 1, wherein the negative source includes a single operational amplifier.

5. The driver circuit as defined in claim 1, wherein the second selector circuit is consisted of low voltage components.

6. The driver circuit as defined in claim 1, wherein the first transistor and the second transistor of the first selector unit are low voltage components.

7. The driver circuit as defined in claim 1, wherein the third transistor and the fourth transistor of the second selector unit are low voltage components.

8. The driver circuit as defined in claim 1, wherein the positive source supplies the first positive signal to the first selector unit and the negative source supplies the second negative signal to the second selector unit when the first source outputs the first positive voltage and the second source outputs the second negative voltage; the positive source supplies the second positive signal to the second selector unit and the negative source supplies the first negative signal to the first selector unit when the first source outputs the first negative voltage and the second source outputs the second positive voltage.

* * * * *